United States Patent [19]

Hawly et al.

[11] Patent Number: 4,762,261

[45] Date of Patent: Aug. 9, 1988

[54] RIVETING ROBOT

[75] Inventors: Rudolf Hawly, Mertingen; Günter Schmid, Augsburg, both of Fed. Rep. of Germany

[73] Assignee: Messerschmitt-Boelkow Blohm Gesellschaft mit beschraenkter Haftung, Munich, Fed. Rep. of Germany

[21] Appl. No.: 915,636

[22] Filed: Oct. 6, 1986

[30] Foreign Application Priority Data

Oct. 7, 1985 [DE] Fed. Rep. of Germany ..... 3535761

[51] Int. Cl.[4] ..... B21J 15/14

[52] U.S. Cl. ..... 227/66; 227/111; 29/243.53; 29/525.2

[58] Field of Search ..... 227/66, 67, 72, 27, 227/51, 52, 57, 110, 111; 29/243.53, 566, 526 A, 564.1, 564.2, 721, 703, 709, 791, 712, 792, 799, 33 J, 33 K, 40, 50, 34 B

[56] References Cited

U.S. PATENT DOCUMENTS

| | | | |
|---|---|---|---|
| 2,456,125 | 12/1948 | Johndrew | 29/243.53 |
| 2,486,378 | 11/1949 | Amiot | 29/243.53 |
| 2,496,330 | 2/1950 | Brown | 29/243.53 |
| 3,534,896 | 10/1970 | Speller et al. | 227/111 |
| 3,536,316 | 10/1970 | De Voss | 227/51 |
| 4,310,964 | 1/1982 | Murphy | 29/703 |
| 4,662,556 | 5/1987 | Gidlund | 29/703 |

*Primary Examiner*—E. R. Kazenske

*Assistant Examiner*—James L. Wolfe

*Attorney, Agent, or Firm*—W. G. Fasse; D. H. Kane, Jr.

[57] ABSTRACT

A computer aided riveting robot has a machine frame for movably mounting a work piece positioning support and riveting tool positioning carriers. A rectangular three-dimensional coordinate system is defined in the machine frame, whereby an x-y-plane (61) constitutes a reference plane. The machine frame extends upwardly from a machine base in the y-direction of the rectangular coordinate system. The work piece positioning support extends upwardly in the y-direction and supports a work piece so that its largest surface area extends approximately in an x-y-plane of the rectangular coordinate system. The work piece positioning support in turn is supported by guide rails for moving the work piece back and forth in the x-direction. Two riveting tool carriers are supported in the machine frame and hold two riveting tools for movement in the z-direction. The tool carriers extend in the y-direction and are so arranged that the work piece extends between the two tool carriers. Each tool carrier supports and positions its riveting tool for movement in the y-direction. Each riveting tool is also tiltable about a fixed axis extending in parallel to the x-axis, so that the respective riveting tool tilts in a y-z-plane. The riveting tools cooperate with each other in a computer aided automatic riveting operation, whereby the computer controls all movements so that each riveting point on a work piece can be reached by the riveting tools.

16 Claims, 3 Drawing Sheets

RIVETING ROBOT

FIELD OF THE INVENTION

The invention relates to a riveting robot for riveting work pieces, especially large surface work pieces, such as aircraft wings or the like. The approach of the riveting tools to the riveting positions is computer aided for an automatic riveting operation.

DESCRIPTION OF THE PRIOR ART

Conventional riveting robots use riveting tongues which are stationary, and which reach around a work piece in the manner of a rigid C-bail. Such riveting tongues carry an upper and a lower riveting system. The robot further includes controlled means for positioning the work piece by combined movements of the work piece in the direction of three axes, as well as rotational or tilting movements of the work piece. These work piece positioning means move the work piece in such a way that the location to be riveted is positioned between the riveting tools of the two riveting systems, whereby the work piece is tilted in such a way that the operational or working axis o the two riveting systems coincides with a line normal to the surface through which the rivet extends or normal to the surface in which the riveting point is located.

Conventional riveting robots of the above type have the following disadvantages. Where the work pieces are large and heavy, it is necessary to provide rigid machine frames capable of taking up high loads for interconnecting or carrying the two riveting systems and the means for the movement control of the work piece. These means in turn must be equipped with high power output motors for the movement in the directions of the three axes of space and for the tilting movement of the work piece. The accessibility to the work pieces is limited, especially when the work pieces have a complicated geometry. The individual work stations, for example a boring or drilling station, a reaming station, a sealer supply station, a riveting station, an edge milling station, and a rivet inspection station by a video camera, are arranged in a linear alignment with one another so that the relative position of the work piece and of the riveting systems must be changed whenever a different work piece is to be riveted or a work sequence is changed.

OBJECTS OF THE INVENTION

In view of the foregoing it is the aim of the invention to achieve the following objects singly or in combination:

to construct a riveting robot which avoids the above disadvantages, yet may be constructed in a lightweight manner;

to provide a better accessibility to the work pieces even if they have a complicated geometry so that rivets may be set in locations which heretofore have not been accessible to the tools of a riveting robot;

to provide a simpler movement and movement control which requires moving less mass, and which is computer aided; and to simplify the work performing steps and the performance of these steps without changing the relative position between a work piece and the riveting systems or riveting tools.

SUMMARY OF THE INVENTION

The riveting robot of the invention is characterized by the following features. A machine frame defines a base in the x-y-plane of a rectangular three-dimensional coordinate system. The machine frame extends upwardly in the y-direction of said coordinate system. A work piece positioning frame extending in the y-direction carries the work piece so that its largest surface area extends approximately in an x-y-plane of said coordinate system. The work piece locating or positioning frame is supported by guide rails for movement in the x-direction. Two riveting tool carrier frames are supported in the machine frame for movement in the z-direction. The tool carrier frames extend in the y-direction and are so arranged that the work piece extends between the two tool carrier frames. Each tool carrier frame supports a riveting tool system for movement in the y-direction. The riveting tool systems cooperate with each other in the computer aided riveting operation. The computer controls the movements whereby each riveting point on the work piece can be reached by the riveting tools.

It is an important advantage of the invention that the work piece needs to be movable only in the x-direction because the adjustment movements needed for bringing the riveting tools into the proper positions for the riveting operations, are performed by moving the riveting systems in the other directions of the three-dimensional coordinate system and by additionally tilting the riveting systems where curved work pieces are involved.

A further important advantage is achieved in that the riveting systems are not rigidly connected to each other, but rather are individually movable in the directions of several axes of a three-dimensional coordinate system and, in addition, are tiltable for placing the riveting tools into the required operational positions. This feature reduces the mass that needs to be moved and controlled, with regard to several axes of the coordinate system, to a substantial extent, whereby the machine frame components of the riveting robot can be constructed substantially lighter than was possible heretofore. Additionally, the drive motors for the movement control do not require as much power as was necessary heretofore. As a result, the entire robot can now be constructed at a substantially lesser expense, yet with improved quality results.

Due to the separation of the riveting tools into two separate systems, it is advantageous that the motions of the riveting tools for reaching the rivet points can be divided into several motion components. Part of the required complete motion may be performed by the tool carrying frames, and another part of the motion may be performed by the tilting of the riveting tools or tool systems all of which tilt through the same tilting angle. The riveting operation and all work steps involved therewith are simplified because the outer riveting system is provided with a revolver head carrying several different tools, whereby it is possible to maintain the same relative position between the work piece and the tool systems for all operationals steps.

Yet another advantage is seen in that work pieces having a complicated geometry may be riveted to each other without any flaws because the inner riveting or tool system has sufficient space to carry a long pressure sleeve which in turn can carry a long riveting anvil which may be pulled back to a substantial extent into the pressure sleeve. The tool end portion of the riveting anvil at the front end of the anvil may be equipped with different types of tools for adaptation to different types of work pieces.

The control of all operations of the riveting robot is performed by a computer in which the coordinate values defining the riveting points are stored. The storing of the rivet point coordinates may be accomplished by an external programming performed by inputting these coordinate values by the automatic reading of a blueprint or with the aid of a monitor. The rivet point coordinates may be also stored in the computer memory by a manual programming operation, especially where complicated work pieces have riveting points, the coordinates of which are hard to define. In this manual programming operation the coordinates are sensed from a reference work piece, template or pattern with the aid of a control ball sensor or scanner and with the aid of observing the work piece, template surface of the reference work piece pattern by a measuring camera installed in a revolver head of the outer riveting tool system. This sensing and observation provides the necessary coordinate data of the riveting holes for storing these data in the computer memory.

The inner riveting tool system may also be manually positioned, for example, by a stepwise movement controlled from a control panel. Part of this displacement control of the inner riveting tool system may include the selective withdrawal of the riveting anvil and/or the rotation of the riveting anvil in any one of its four possible positions rotated by 90° relative to each other.

The inner riveting tool system may include an observation camera for recognizing undesirable or disturbing contours on the inner surface of the work piece to be riveted. When such contours are recognized, the inner riveting anvil may be adjusted in response to signals representing such disturbing contrours. This operation of taking disturbing contours into account may also be performed in a semi-automatic manner by moving the observing camera to the rivet holes with the aid of the coordinate data stored in the computer. If then the position of the observing camera and the actual position of the rivet hole do not coincide with each other, a correction may be manually made by causing a manual displacement of the riveting tools to eliminate the misalignment. All rivet holes or bores in the reference pattern are numbered so that at a later time only the respective hole numbers must be entered into the computer for again finding the bore hole or rivet hole in the actual work piece of the same type, e.g., a wing section.

Work pieces having a curved contour which is programmable, simplify the locating of the rivet holes or rather, their central null points or axes, substantially in that the work piece contour is stored in the computer and in that a base reference plane is established in a three-dimensional coordinate system in which the work piece is located This reference plane is an x-y-plane extending perpendicularly to the z-axis. With such a reference plane established, it is merely necessary to determine ach riveting point as a deviation from base values which are stored in the computer. These deviations determine the riveting point location in the x- and y-direction and are also stored in the computer. These stored values provide exactly defined displacement paths for the riveting tool positioning frames and for the riveting tools or systems, whereby it becomes possible to continuously control, and if necessary, to correct the exact position of the riveting points, or rather, the required displacement to reach these riveting points. Hereby length measuring and angle measuring devices having a fine resolution are used for this control and correction of any misalignments.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
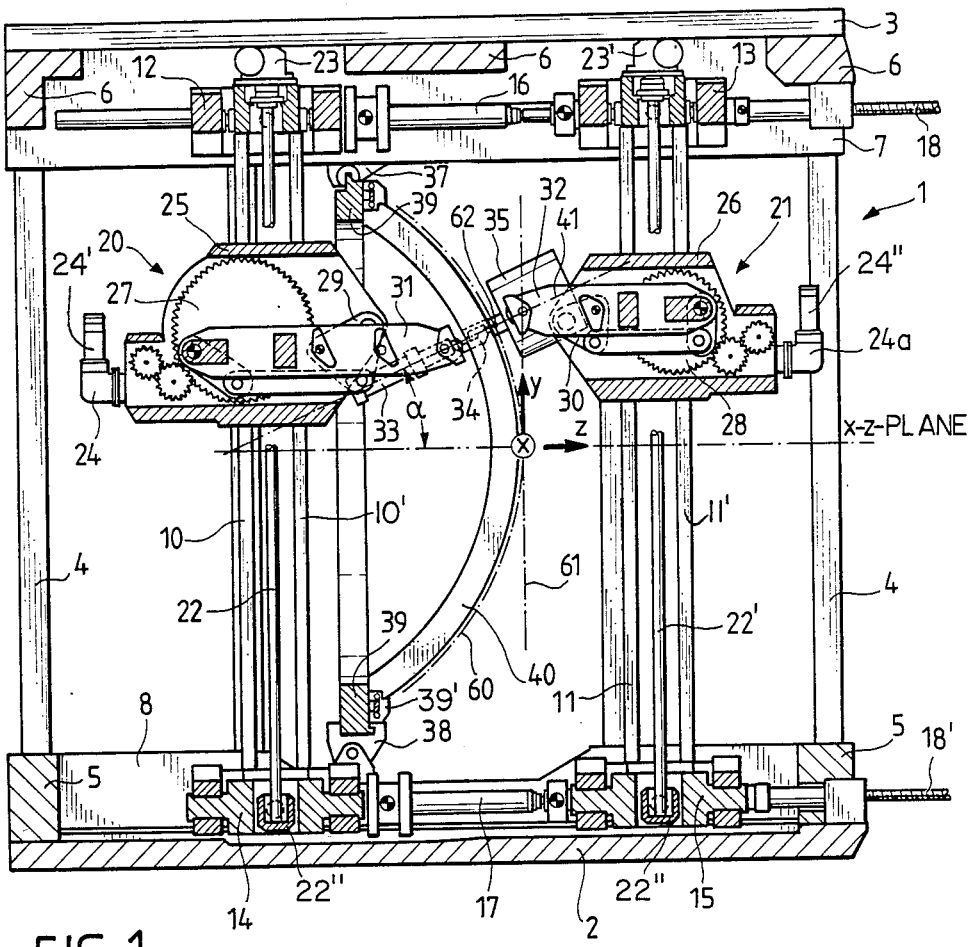
FIG. 1 is a sectional view through the riveting robot according to the invention, wherein the section plane coincides with a y-z-plane defined by the y- and z-directions of a three-dimensional rectangular coordinate system in which the x-axis extends perpendicularly to the plane of the drawing in which said y-z-plane is located.

The robot according to the invention shown in FIG. 1 comprises a machine frame 1 with a base plate 2 resting on a floor, an upper crossbeam 3, upright posts 4, and lower longitudinal beams 5 and 8 and upper longitudinal beams 6 and 7 forming frame members 5 to 8.

A three-dimensional, rectangular coordinate system is defined in the machine frame 1 as follows. The longitudinal direction is the x-direction extending perpendicularly to the plane of the drawing and in parallel to the machine floor. The y-direction extends vertically upwardly. The z-direction extends horizontally and perpendicularly to the plane defined by the x- and y-directions. An x-z-plane extends perpendicularly to the plane defined by the drawing sheet. An x-y-plane forms a reference or base plane 61 and is defined by the x- and y-directions.

Riveting tool carrying and positioning frames 10 and 11 are supported in the machine frame 1 so that they extend in the y-direction and are displaceable in the z-direction. For this purpose the upper end of the tool carrying frame 10 is supported by a slide carriage 12 while the lower end of the frame 10 is supported by a slide carriage 14. The upper end of the frame 11 is supported by a slide carriage 13. The lower end of the frame 11 is supported by a slide carriage 15. The pair of upper slide carriages 12 and 13 is supported by the upper crossbeam 7 for back and forth movement in the z-direction. The pair of lower slide carriages 14 and 15 is supported by the lower crossbeam 8 for back and forth movement in the z-direction. The upper slide carriages 12 and 13 are interconnected in a universal joint manner by a telescoping connector link 16. The lower carriages 14 and 15 are also interconnected in a universal joint manner by a telescoping connecting link 17. An upper drive spindle 18 is connected to the upper carriages 12 and 13. A lower drive spindle 18' is connected to the lower slide carriages 14 and 15. Both drive spindles 18, 18' are driven in synchronism by a motor not shown for displacing the slide carriages 12, 13, 14, and 15, and thus the tool carrying frames 10 and 11 horizontally back and forth in the z-direction. The instantaneous position of these frames 10 and 11 is controlled in response to signals provided by conventional displacement measuring systems which provide respective electrical signals for controlling the synchroneous operation of the spindles 18 and 18'. Such displacement control is conventional per se. However, a suitable displacement measuring device is, for example, manufactured by the Firm Heidenhain in West Germany. Heidenhain distance measuring devices have a resolution of 0.01 mm and provide the necessary output signal for the control of the drive motors for the spindles 18, 18'.

The frames 10 and 11 carry respective riveting tools or riveting systems 20 and 21. The entire systems are displaceable vertically up and down along the frames 10 and 11 with the aid of drive spindles 22 and 22' extending in the y-direction. The drive spindles 22 and 22' are driven by a respective alternating current electric motor 23 and 23'. The drive spindles 22, 22' are preferably of the so-called ball threaded type mounted at the lower end in bearings 22''. The frames 10, 11 have guide rails 10', 11' respectively for guiding the up and down movement of the housings 25, 26 of said riveting tools 20 and 21.

The tilting movements of the riveting tools 20 and 21 are driven by alternating electric current motors 24 and 24*a*. Eachmotor has its own brake 24' and 24'', respectively. The motor 24 drives, through a reduction gear 27 mounted in the housing 25 and through a lever system 29, a tiltable support arm 31 for tilting inner riveting tools 33, 34 relative to the x-z-plane as indicated by the angle $\alpha$. The motor 24*a* drives an outer riveting tool 35 mounted on a tiltable support arm 32 through a respective reduction gear 28 and a lever mechanism 30 for a respective tilting so that the riveting tools 33, 34, 35 will remain aligned with an axis 41 referred to as the rivet null line and extending centrally through a rivet hole in the work piece 40. The inner tools comprise a pressure sleeve 33 and a riveting anvil 34 carried by the arm 31. The outer riveting tools comprise a revolver head 35 carried on the arm 32 and holding a plurality of work performing tool members.

An upper guide rail 37 is secured to the upper crossbeam 7 and a lower guide rail 38 is secured to the lower crossbeam 8. Both guide rails 37 and 38 extend in the x-direction. A work piece carrying frame 39 is guided by these upper and lower guide rails 37, 38 for movement back and forth in the x-direction. A work piece 40 is secured, for example, by clamping devices 39' to the carrier frame 39. The work piece 40 is, for example, a spar element of an aircraft fuselage. The displacement of the work piece carrier frame 39 in the x-direction is accomplished by a conventional drive motor and gear system controlled by the computer which makes sure that the riveting tools 33, 34, 35 in their riveting position are axially aligned relative to the rivet null line 41.

In view of the above it is clear that the relative movement in the x-direction is provided by the displacement of the work piece itself, or rather, by the frame 39 carrying the work piece. The relative displacement in the y-direction is accomplished by the up and down movement of the rivet tool systems 20 and 21 with the respective housings 25 and 26 guided along the guide rails 10' and 11'' of the tool carrier frames 10 and 11. The movement in the z-direction is provided by the spindles 18, 18' which may displace the frames 10, 11 in unison or separately under the control of a computer. The angular movement is provided by the motors 24, 24*a* as described also under computer control.

Figure 2:
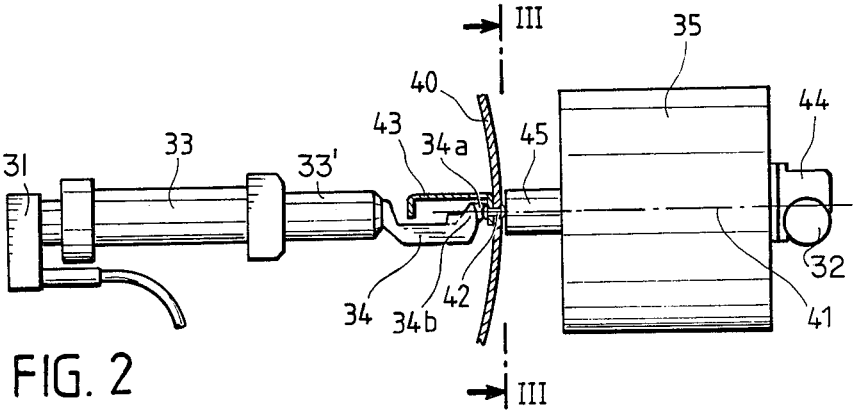
FIG. 2 is a detailed illustration of the two riveting tool systems, whereby the right-hand tool system is referred to as the outer system, and the left-hand tool system is referred to as the inner system.
Figure 3:
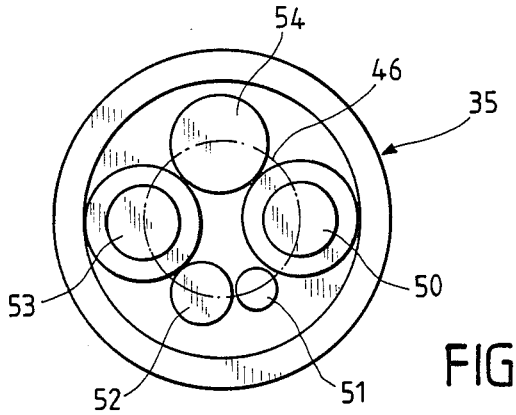
FIG. 3 is a view from left to right perpendicularly to the plane III—III shown in FIG. 2.

FIGS. 2 and 3 show further details of the riveting tools. Referring specifically to FIG. 2, the riveting anvil 34 is carried by a piston rod 33' of the pressure sleeve or piston cylinder device 33. The riveting anvil 34 has at its outer free end a riveting hammer 34*a* for hammering a rivet 42 for connecting a stringer 43 to a spar element 40. The riveting anvil 34 may be rotatable with its piston rod 33' into four separate positions displaced by 90° relative to each other as is known in the art. The free end of the riveting anvil 34 may also be equipped, or may be equipped in the alternative, with a counterholder 34*b* for holding the stringer 43 in place. The revolver head 35 is rotatable by a motor 44. A counterholder 45 is shown in its extended working position.

As shown in FIG. 3 the revolver head 35 is provided with five bores, each of which receives a tool for a different work function. The bores are located with their centers on a circle 46 which is so located that rotation of the revolver head 35 keeps the circle 46 aligned with the rivet null line 41. In other words, the circle 46 travels through the null line 41. The following tools may, for example, be mounted in the revolver head 35. A tool 50 for a boring and countersinking function, a tool 51 for spraying a sealer into a rivet hole, a tool 52 for supplying rivets into a rivet hole, and for counter holding the inserted rivet, a tool 53 which may, for example be exchangeable by other tools for different purposes, such as edge milling, rivet head smoothing, and scanning of the rivet hole geometry by a camera, and a tool 54, such as a video camera for observing and monitoring the functions of the tools 50 to 53.

Figure 4:
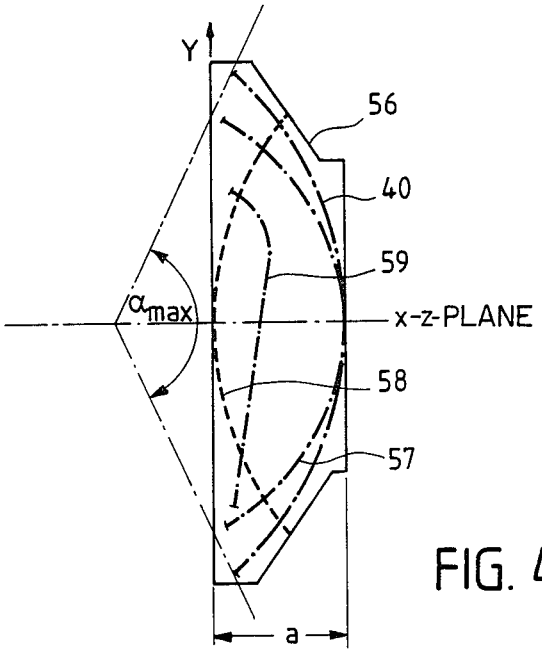
FIG. 4 illustrates the operational range of the present riveting robot.

FIG. 4 illustrates the working range or reach 56 of the present robot in the x-y-plane with the x-z-plane extending perpendicularly to the y-z-plane as in FIG. 1. This reach is determined by the angle $\alpha_{max}$ relative to the x-z-plane, which is, for example, 130°. Thus, the angle $\alpha$ in each direction away from the x-z-plane is 65°. The reach is further determined by the displacement "a" in the z-direction of the tool carrier and positioning frames 10 and 11. The contour of the work piece 40 is shown to lie entirely within the reach 56. Other example contours 57, 58, and 59 of work pieces are also shown to lie within the reach 56. Thus, the robot according to the invention can handle all contours which fit within the reach as described.

The present apparatus operates as follows. First, the basic geometry of the work piece 40 is ascertained. In the shown example in which the work piece 40 is a spar element of an aircraft fuselage, the basic geometry of the spar element coincides with the sheer line 60, please see FIG. 1. Then the reference plane 61 is determined in the x-y-plane so that the base plane 61 extends through the intersection of the sheer line 60 with the x-z-plane. Thereafter, all rivet positions are determined which provide rivet null points 62 located where the rivet null lines 41 intersect the sheer line 60. These rivet null points 62 have respective x- and y-coordinate values relative to the sheer line 60 and relative to the reference plane 61. These coordinate values are then stored in the memory of the computer. Each rivet null point receives its own number so that each of these points can be approached by the tools automatically and in an always reproduceable manner because there is also stored in the computer the programmed value regarding the displacement speed of the positioning frames 10 and 11 and of the riveting tool systems 20 and 21 when the respective rivet hole number is called up.

The present apparatus is able to handle conventional rivets with a countersunk head which are upset by the riveting anvil 34. Additionally the present robot can also handle press-fit rivets with a threading, whereby the tool 50 drills a fitting hole which is then reamed, whereupon the fitting rivet is supplied by the tool 52 and pressed into the hole. During this operation the inner tool system with its pressure sleeve 33 and the riveting anvil 34 is withdrawn so that the press-fit rivet can be provided with a nut on its inner thread end.

Figure 5:
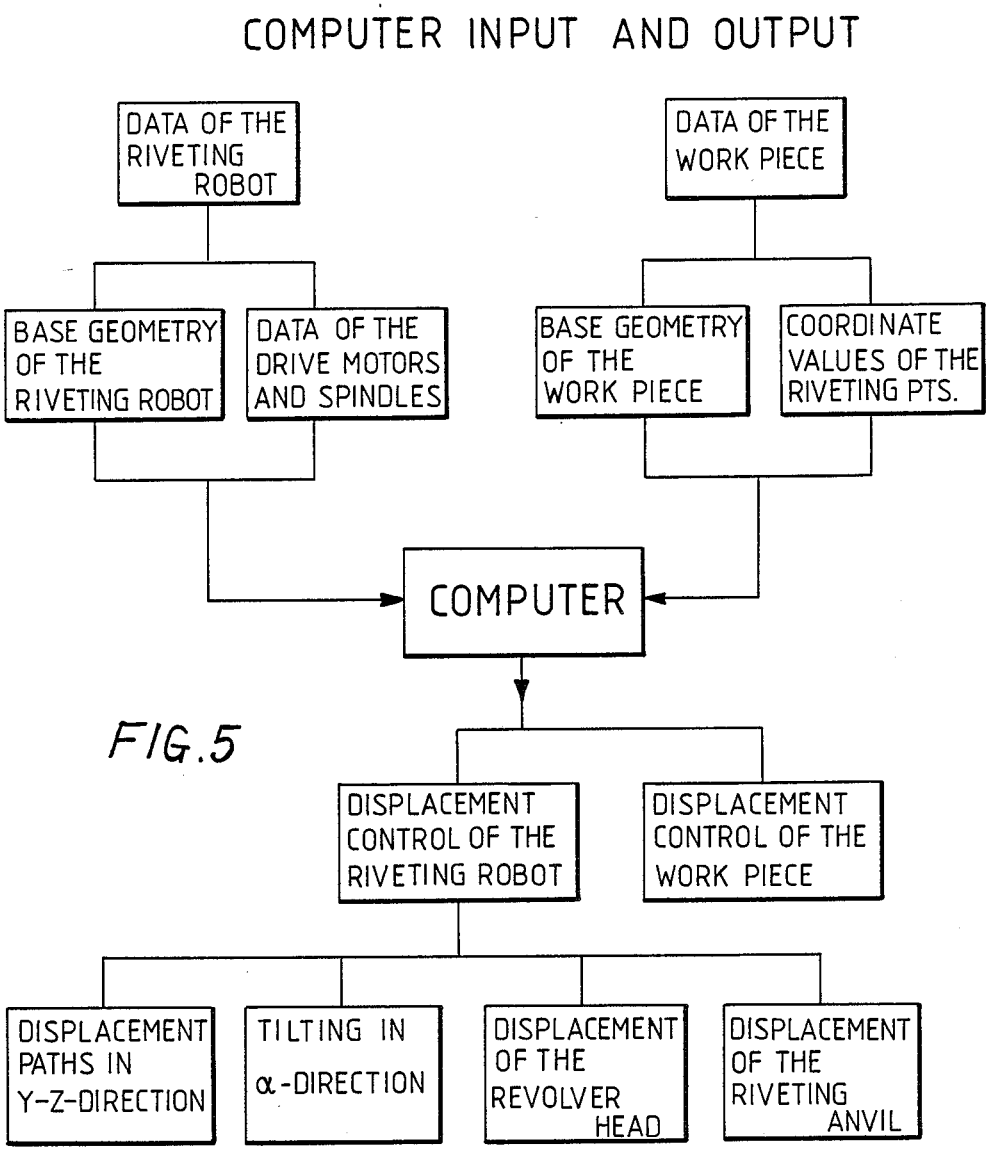
FIG. 5 is a block diagram of the computer control circuit.

The present riveting robot operates as follows. A work piece 40 is inserted into the carrier frame 39. The work piece carrier frame 39 is moved into position between the tool carrying and positioning frames 10, 11. The number of a rivet null point 62 is called up by the program in the computer shown in FIG. 5. The computer controls the displacement of the frames 10, 11 and of the riveting tool systems 20, 21 to the rivet null point 62. The counter holder 45 is caused to move into contact with the surface of the work piece 40. Tool members in the tool 50 drill and countersink a rivet hole. A sealer is sprayed by tool 51 into the rivet hole. A rivet is supplied into a rivet hole by the tool 52 which also counterholds an inserted rivet. The riveting operation is performed by the riveting anvil 34 while the tool 52 counterholds. The tool 53 smooths the rivet head. The video camera 54 checks the rivet head. The number of the next rivet hole 62 is called up and so forth. Upon completion of all rivets, the work piece carrier frame 39 is moved out and the work piece 40 removed.

Although the invention has been described with reference to specific example embodiments, it will be appreciated, that it is intended to cover all modifications and equivalents within the scope of the appended claims.

What we claim is:

1. A robot for riveting work pieces, especially large surface work pieces, such as an aircraft wing component or aircraft fuselage component, comprising machine frame means (1) defining a rectangular, three-dimensional coordinate system, said coordinate system having an x-axis, a y-axis, and a z-axis, said machine frame means comprising a base (2) extending perpendicularly to said y-axis, said machine frame means comprising upright frame members (4) secured to said machine base and extending in parallel to said y-axis, said machine frame further comprising horizontally extending upper and lower frame members (3, 6, 7; 5, 8) interconnecting said upright frame members, said robot further comprising work piece positioning means (39) for supporting a work piece (40) so that the largest work piece surface dimension extends approximately an an x-y-plane, guide means (37, 38) mounted in said machine frame means for guiding said work piece positioning means (39) for moving in a direction of said x-axis, first and second riveting tool positioning means (10, 11) extending in a direction of said y-axis, first drive means (18, 18') connected to said first and second riveting tool positioning means (10, 11) for displacing said first and second riveting tool positioning means, said work piece positioning means (39) being located between said first and said second riveting tool positioning means (10, 11), first and second riveting tool means (20, 21) supported respectively by said first and second riveting tool positioning means (10, 11), second drive means (22, 22') connected for displacing said first and second riveting tool means (20, 21) in a direction parallel to said y-axis along said first and second riveting tool positioning means (10, 11), said first and second riveting tool means cooperating with each other for performing a riveting operation, and computer means including a monitor connected for controlling said first and second drive means (18, 18'; 22, 22'), and said first and second riveting tool means (20, 21) for moving said first and second riveting tool means (20, 21) to any riveting point of the work piece (40) for performing a riveting operation.

2. The robot of claim 1, wherein said first and second riveting tool positioning means (10, 11) comprise upper slides (12, 13) and lower slides (14, 15), said first drive means comprising spindles (18, 18') engaging said upper and lower slides for displacing said slides along said upper and lower frame members, said robot further comprising universal coupling means (16, 17) for coupling said slides (12, 13; and 14, 15) with each other, respectively, in a universal joint manner.

3. The robot of claim 1, wherein said riveting tool means (20, 21) are tiltably secured to said riveting tool positioning means (10, 11) for riveting of work pieces having a curved surface, said robot further comprising third drive means **(24, 24*a*)** for tilting said riveting tool means into operating positions in which said riveting tool means oppose each other at a riveting null point and in alignment with each other along a riveting null line extending perpendicularly to a tangent to a radius of curvature of said work piece at said riveting null point defined as an intersection of said tangent and said riveting null line, said riveting null line extending centrally through a rivet hole in said work piece.

4. The robot of claim 3, wherein said third drive means for moving said riveting tool means (20, 21) comprise computer controlled motors **24, 24*a*), reduction gears (27, 28) connected to said computer controlled motors, kinematic power transmitting means (29, 30) connected to said reduction gears for driving said kinematic power transmitting means (29, 30), and carrier arms (31, 32) for supporting said riveting tool means (20, 21)**, said carrier arms being connected to said kinematic power transmitting means for said moving of said riveting tool means by said computer controlled motors.

5. The robot of claim 4, wherein said riveting tool means comprise an inner riveting system (33) and an outer riveting system (35) each carried by its respective carrier arm (31, 32), said outer riveting system comprising a rotatable revolver head (35) and an electric motor (44) for rotating said revolver head, said revolver head comprising a plurality of tool members (50, 51, 52, 53, 54) having functional axes arranged on and perpendicularly to a circle (46), whereby a normal coinciding with any of said functional axes on any point of said circle passes through said riveting null line.

6. The robot of claim 5, wherein said plurality of tool members comprise the following work performing tool members in said revolver head, namely:

(a) means (50) for drilling and countersinking, (b) means (51) for injecting a sealer into a rivet hole, (c) means (52) for supplying and counterholding rivets, (d) exchangeable means (53) for performing special functions, for example, edge milling means, rivet head smoothing means, or sensing means such as a camera for sensing a rivet hole geometry to provide control information to said computer means, and (e) video camera means (54) for monitoring the functions of said means (a) to (d).

7. The robot of claim 5, wherein said inner riveting system comprises a pressure sleeve and a riveting anvil movable into and out of said pressure sleeve mounted on its respective carrier arm, said riveting anvil being rotatable into four positions spaced from one another by 90°.

8. The robot of claim 7, wherein said riveting anvil comprises at its tip a U-shaped counterholder having U-legs and a riveting hammer which is displaceable between said U-legs of said counterholder.

9. The robot of claim 3, wherein said computer means comprise memory means in which the geometry of said riveting null points is stored with the aid of a blueprint or with the aid of said monitor included in said computer means.

10. The robot of claim 3, wherein said computer means comprise memory means for storing control information, said robot further comprising electro-optical sensing means connected to said memory means for providing said control information including information representing coordinates of said rivet null points and information representing required displacements of said riveting tool means for performing a riveting.

11. The robot of claim 10, wherein said riveting tool means comprise an inner riveting system (33) and an outer riveting system (35), said electro-optical sensing means comprising a semiconductor camera (53) mounted on said outer riveting system (35) for sensing said information from a reference work piece or pattern, said computer means using said information for said controlling.

12. The robot of claim 10, wherein said riveting tool means comprise an inner riveting system and an outer riveting system, said electro-optical sensing means comprising a semiconductor camera mounted on said inner riveting system for sensing said information from a reference work piece or pattern, said computer means using said information for said controlling.

13. The robot of claim 10, for riveting a curved work piece having a programmable curvature, wherein said rectangular coordinate system defined by said frame means includes an approximately centrally located horizontally extending x-z-plane, and a vertically extending reference x-y-plane (61) extending perpendicularly to said x-z-plane, said computer memory means having stored therein information representing displacement paths for said first and second riveting tool positioning means and displacement paths for said first and second riveting tool means as fixed and determined for said curved work piece having said programmable curvature, said computer memory means further including information representing said riveting null points determined only in the x- and y-directions as deviations from said centrally located x-z-plane and as deviations from said reference x-y-plane.

14. The robot of claim 13, wherein said rivet null points are numbered and wherein each rivet null point is approachable by said riveting tool means under the control of said computer means.

15. The robot of claim 13, further comprising longitudinal or angle measuring means having a fine resolution for measuring a displacement path of said first and second riveting tool positioning means and a displacement path of said riveting tool means for providing respective feedback information to said computer means.

16. The robot of claim 1, wherein said riveting tool means comprise a riveting anvil (34) and a pressure sleeve (33) for riveting countersunk rivets and snug-fit rivets having a threading, whereby for riveting of said snug-fit rivets said pressure sleeve with its riveting anvil is withdrawn from the work piece.

* * * * *